US009022116B2

(12) United States Patent
Bell et al.

(10) Patent No.: US 9,022,116 B2
(45) Date of Patent: May 5, 2015

(54) SHAPED CHARGE TUBING CUTTER

(76) Inventors: William T. Bell, Huntsville, TX (US); James G. Rairigh, Houston, TX (US)

( * ) Notice: Subject to any disclaimer, the term of this patent is extended or adjusted under 35 U.S.C. 154(b) by 323 days.

(21) Appl. No.: 13/506,691

(22) Filed: May 10, 2012

(65) Prior Publication Data

US 2013/0299194 A1 Nov. 14, 2013

(51) Int. Cl.

| | |
|---|---|
| ***E21B 29/02*** | (2006.01) |
| ***E21B 43/116*** | (2006.01) |
| ***F42B 1/02*** | (2006.01) |
| ***F42B 1/028*** | (2006.01) |
| ***F42B 3/00*** | (2006.01) |

(52) U.S. Cl.

CPC ..... *E21B 29/02* (2013.01); *F42B 1/028* (2013.01); *F42B 3/00* (2013.01)

(58) Field of Classification Search

USPC ..... 166/297, 55, 298; 89/1.15; 102/306–310

See application file for complete search history.

(56) References Cited

U.S. PATENT DOCUMENTS

| | | | | |
|---|---|---|---|---|
| 2,873,675 | A | 2/1959 | Lebourg | |
| 3,057,295 | A * | 10/1962 | Christopher | 175/4.6 |
| 5,159,145 | A * | 10/1992 | Carisella et al. | 89/1.15 |
| 6,792,866 | B2 * | 9/2004 | Grattan | 102/310 |
| 7,073,448 | B2 | 7/2006 | Bell | |
| 7,661,367 | B2 | 2/2010 | Yang et al. | |

* cited by examiner

*Primary Examiner* — Giovanna Wright
*Assistant Examiner* — Catherine Loikith

(57) ABSTRACT

A shaped charge pipe cutter is constructed with the cutter explosive material packed intimately around an axially elongated void space that is continued through a heavy wall boss portion of the upper thrust disc. The boss wall is continued to within a critical initiation distance of a half-cuter junction plane. An explosive detonator is positioned along the void space axis proximate of the outer plane of the upper thrust disc. Geometric configurations of the charge thrust disc and end-plate concentrate the detonation energy at the critical initiation zone.

5 Claims, 4 Drawing Sheets

SHAPED CHARGE TUBING CUTTER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to shaped charge tools for explosively severing tubular goods including, but not limited to, pipe, tube, casing and/or casing liner.

2. Description of Related Art

The capacity to quickly, reliably and cleanly sever a joint of tubing or casing deeply within a wellbore is an essential maintenance and salvage operation in the petroleum drilling and exploration industry. Generally, the industry relies upon mechanical, chemical or pyrotechnic devices for such cutting. Among the available options, shaped charge (SC) explosive cutters are often the simplest, fastest and least expensive tools for cutting pipe in a well. The devices are typically conveyed into a well for detonation on a wireline or length of coiled tubing.

Typical explosive pipe cutting devices comprise a consolidated wheel of explosive material having a V-groove perimeter such as a V-belt drive sheave. The circular side faces of the explosive wheel are intimately formed about an axis of revolution against circular metallic end plates. The external surface of the circular V-groove is clad with a thin metal liner. An aperture along the wheel axis provides a receptacle path for a detonation booster.

This V-grooved wheel of shaped explosive is aligned coaxially within a housing sub and the sub is disposed internally of the pipe cutting subject. Accordingly, the plane that includes the circular perimeter of the V-groove apex is substantially perpendicular to the pipe axis.

When detonated at the axial center, the explosive shock wave advances radially along the apex plane against the V-groove liner to drive the opposing liner surfaces together at an extremely high velocity of about 30,000 ft/sec. This high velocity collision of the V-groove liner material generates a localized impingement pressure within the material of about 2 to $4\times10^6$ psi. Under pressure of this magnitude, the liner material is essentially fluidized.

Due to the V-groove geometry of the liner material, the collision reaction includes a lineal dynamic vector component along the apex plane. Under the propellant influence of the high impingement pressure, the fluidized mass of liner material flows lineally and radially along this apex plane at velocities in the order of 15,000 ft/sec. Resultant impingement pressures against the surrounding pipe wall may be as high as 6 to $7\times10^6$ psi thereby locally fluidizing the pipe wall material.

Traditional fabrication procedures for shaped charge pipe cutters have included an independent formation of the liner as a truncated cone of metallic foil. The transverse sections of the cone are open. In a forming mold with the liner serving as a bottom wall portion of the mold, the explosive is formed or molded against the concave conical face of the liner. At the open center of the truncated apex of the liner, the explosive is formed against the mold bottom surface and around a cylindrical core.

With the precisely desired explosive material in place, an end plate is aligned over the cylindrical core and pressed against the upper surface of the explosive material at a controlled rate and pressure in the manner of a press platen. When removed from the forming mold, the unified liner-explosive-backing plate comprises half of a shaped charge pipe cutter.

To complete a full cutter unit, two of the shaped charge half sections, separated from the cylindrical core mold, are joined along a common axis at a contiguous juncture plane of exposed explosive at the truncated apex face planes. A detonation booster is inserted along the open axial bore of the unit left by the molding core. This detonation booster traverses the half charge juncture plane to bridge the explosive charges respective to the two half sections between the opposing end plates. The charged cutter is inserted into a cutter housing that is secured to a cutter sub.

A notable characteristic of secondary order explosives of the type used in shaped charge cutters such as RDX and HMX is that the detonation velocity roughly corresponds to the compression density of the charge. A greater charge density generally increases the detonation velocity. Hence, more densely compressed charges, generally, are more energetic, emit greater velocity jets and generate greater cutting pressure. However, another characteristic of densely compressed high explosives is a greater difficulty to detonate. It has been a general rule of practice, therefore, that more densely compressed, energetic charges require larger, more intimately positioned ignition boosters.

Larger boosters, for more densely compressed explosives, introduce other complications to the downhole tubing cutter design. Larger boosters require larger diameter axial apertures in the cutter explosive geometry thereby reducing the available volume within the explosive material envelope for high explosive material.

It must be recognized that for a given nominal pipe size, there is a corresponding inside diameter. A cutter housing, meaning the housing outside diameter, must fit loosely within the inside diameter of the pipe that is to be cut. The outside diameter of the cutter explosive wheel must fit within the housing and the outside diameter of the explosive wheel substantially dictates the depth of the liner V-groove.

As the dimensional restrictions progress radially inward, a final distance absolute arises between the inside diameter wall of the booster aperture and the V-groove apex. The radial depth of this annular plane between the V-groove apex and the aperture wall is characterized as the "induction" distance. If insufficient, the explosive detonation will not decompose the liner material into a lineal cutting jet. There is advantage, therefore, for using the smallest diameter booster (and, hence, aperture diameter) that will reliably detonate the cutter charge.

International standards of transportation safety (UN Recommendations on the Transport of Dangerous Goods, Section 16) require that high order explosives such as HMX and RDX are packaged in a manner to promote deflagration rather than explosion upon uncontrolled heating as in an accidental fire. In general, compliance with this regulation precludes any sealed enclosure or confinement of the cutter explosive. If heated, an unconfined explosive will simply out-gas and burn. If the explosive is confined, however, the gas may develop sufficient pressure to initiate a detonation. Hence, in the interest of safety, there should be a gas venting route in any transport packaging.

To comply with these safety requirements, shape charge cutter equipment is therefore transported to a job site in various degrees of disassembly.

Unfortunately, the environmental circumstances of a drilling rig floor, which is where final cutter assembly must occur, are often hostile and usually not conducive to the attentive care required for final assembly of a high explosive tool. Hence, there are strong incentives to transport a cutter unit to the job site in the greatest degree of assembly that safety, prudence and regulation allow.

A representative cutter assembly usually requires the shaped charge explosive to be positioned within an environmental housing which is atmospherically open and unsealed for transport. When finally assembled for downhole placement and detonation, an explosive booster charge is positioned in the axial aperture through the explosive cones. The cutter housing is secured to a top sub which seals the housing enclosure. The housing and top sub are secured to a firing head having an electrically initiated detonator and a capacitive discharge circuit. Upon final assembly for downhole placement and detonation, the housing, top sub and firing head are secured together as a firing unit. When assembled, the detonator is physically positioned in ignition proximity to the booster and the combination of housing, top sub and firing head is totally sealed from the environment outside the housing wall. In process sequence, surface signals prompt a capacitive discharge circuit to electrically discharge into the detonator. The detonator discharge initiates the booster within the axial aperture proximate of the explosive cone interface. The booster ignition detonates the explosive cutter cones.

Each of these firing unit assembly joints is hydraulically sealed by an O-ring. As normally fabricated, however, there is an open channel space along the axis of the assembled unit. Consequently, the opportunity exists at each of the assembly joints for external pipe bore fluid to enter the open channel space and corrupt the shaped charge explosive in the event of O-ring seal failure. This opportunity is exacerbated by rough or poorly machined seal surfaces.

The mechanics of O-ring sealing includes a pressure differential induced distortion of the polymer material from which the O-ring is made. Under a high pressure differential, these principles are extremely reliable. Under a low pressure differential, a fluid tight seal is much more problematic if the seal surfaces are roughly machined or corrupted by deposits. If the pressure differential upon the O-ring is insufficient to force-flow the O-ring polymer material into intimate sealing contact withal of the sealing surface, fluid will by-pass the seal and enter the forbidden zone. For explosive tools such as shaped charge cutters and perforators, such low pressure leakage may be disabling.

Curiously, in a deep well environment, a tool with a low pressure leak may ultimately acquire a complete seal as the tool descends into realms of greater pressure.

To further simplify the job site assembly task, it would be helpful, therefore, to eliminate the need for an explosive booster thereby initiating the cutter explosion only by the firing head detonator. It would also be helpful to provide an internal fluid seal means along the internal channel of the assembly firing unit.

Over years of experience, use and experimentation, the explosion dynamics of shaped charge cutters has evolved dramatically. Some prior notions of critical relationships have been revealed as not so critical. Other notions of insignificance have been discovered to be of great importance. The summation of numerous small departures from the prior art traditions has produced significant performance improvements or significant reductions in fabrication expense.

BRIEF SUMMARY OF THE INVENTION

The present invention pipe cutter comprises several design and fabrication advantages that include a half cutter fabrication procedure that compresses the explosive material intimately around an axially centered core mandrel to form an axial aperture that is continued through an end plate characterized herein as an upper thrust disc and a lower end plate. In this embodiment of the invention, a charge detonator is positioned along the tool axis adjacent the outer surface plane of the thrust disc. There is no need for an independently prepared booster or booster material that is an article separate from the thrust disc. Although the axial aperture remains as an essential cutter element, the diameter of the aperture may be significantly reduced. The charge detonator initiates the cutter explosive charge from a plane substantially common with outer surface plane of the thrust disc. While the detonation initiation point is axially displaced from the half cutter junction plane, the detonation energy wave is propagated along an aperture within a heavy wall boss to a critical initiation distance adjacent the junction plane. The heavy wall of the boss protects the cutter explosive from asymmetric detonation as the energy wave travels along the aperture to the juncture plane.

Another, similar embodiment of the invention provides a dense material plug in the lower end plate aperture to reflect the detonation wave back upon itself at the juncture plane. As before, the heavy wall of the boss protects the cutter explosive from asymmetric detonation as the energy wave travels along the aperture.

Another invention embodiment provides a tapered wall for the upper thrust disc aperture. The taper angle of the aperture converges from the exterior surface of the upper backing plate (thrust disc) toward the cutter explosive at about 5° from the tool axis. The small, terminus end of the aperture coincides with the upper plane of the critical ignition space above the half-cutter junction plane.

Also featured by the present invention is a fluid seal element between the open channel along the firing unit and the interior volume of the cutter housing to reliably prevent the migration of moisture into the cutter housing due to leaks into the open channel from faulty seals above the cutter housing.

BRIEF DESCRIPTION OF THE SEVERAL VIEWS OF THE DRAWINGS

The invention is hereafter described in detail and with reference to the drawings wherein like reference characters designate like or similar elements throughout the several figures and views that collectively comprise the drawings. Respective to each drawing figure.

DETAILED DESCRIPTION OF THE INVENTION

As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate. Moreover, in the specification and appended claims, the terms "pipe", "tube", "tubular", "casing", "liner" and/or "other tubular goods" are to be interpreted and defined generically to mean any and all of such elements without limitation of industry usage.

Figure 1:
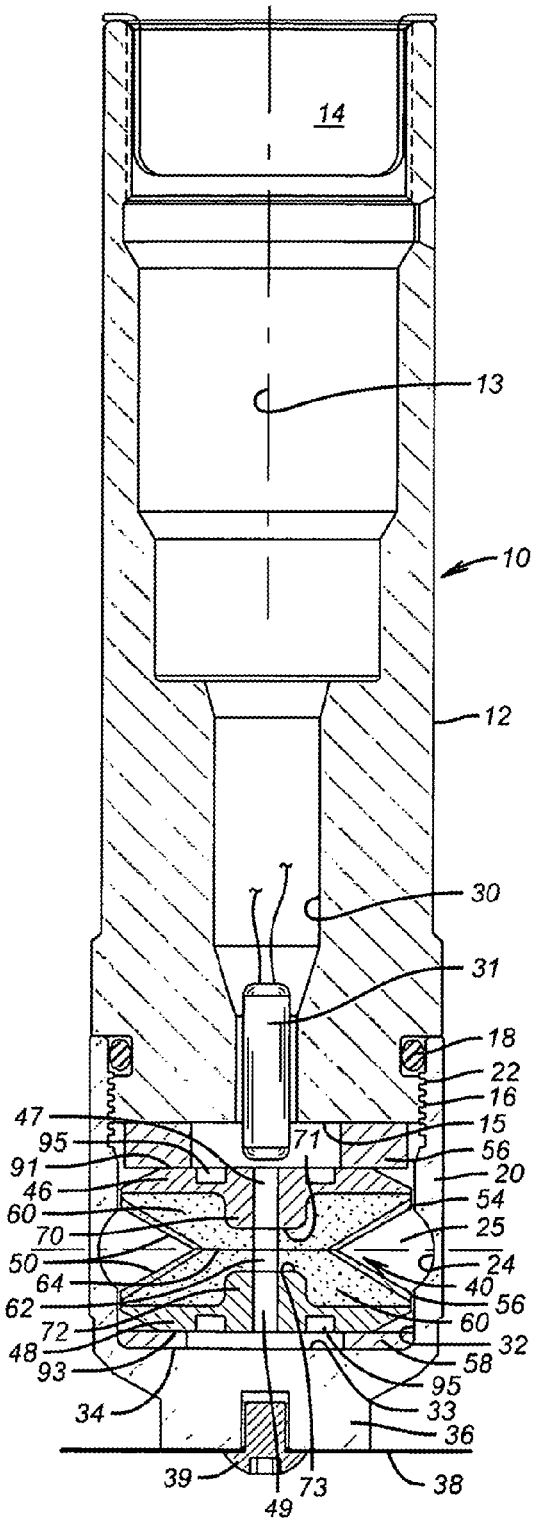
FIG. 1 is a cross-section of a first embodiment of the invention in assembly with the housing, centralizer and connecting sub.

Referring initially to the invention embodiment of FIG. 1, the cutter assembly 10 comprises a top sub 12 having a threaded internal socket 14 that axially penetrates the "upper" end of the top sub. The socket thread 14 provides a secure mechanism for attaching the cutter assembly with an appropriate wire line or tubing suspension string not shown. In general, the cutter assembly has a substantially circular cross-section. Consequentially, the outer configuration of the cutter assembly is substantially cylindrical. The "lower" end of the top sub includes a substantially flat end face 15. The end face perimeter is delineated by a housing assembly thread 16 and an O-ring seal 18. The axial center 13 of the top sub is bored between the assembly socket 14 and the end face 15 to provide a socket 30 for an explosive detonator 31.

The cutter housing 20 is secured to the top sub 12 by an internally threaded sleeve 22. The O-ring 18 seals the interface from fluid invasion of the interior housing volume. A jet window section 24 of the housing interior is that inside wall portion of the housing 20 that bounds the jet cavity 25 around the shaped charge between the outer or base perimeters 52 and 54 of the liners 50. Preferably, the upper and lower limits of the jet window 25 are coordinated with the shaped charge dimensions to place the window "sills" at the approximate mid-line between the inner and outer surfaces of the liner 50. Representatively, the shaped charge housing 20 may be a frangible steel material of approximately 55-60 Rockwell "C" hardness.

Below the jet window 25, the cutter housing cavity is internally terminated by an integral end wall 32 having a substantially flat internal end-face 33. The external end-face 34 of the end wall may be frusto-conical about a central end boss 36. A hardened steel centralizer assembly 38 may be secured to the end boss by an assembly bolt 39.

Figure 9:
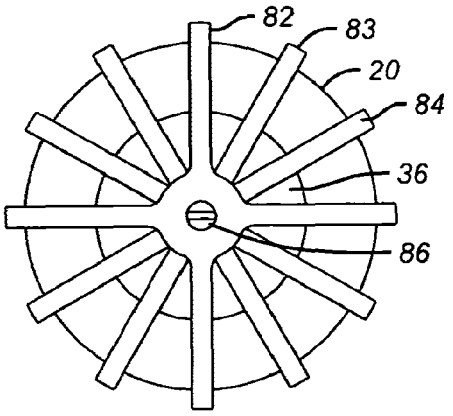
FIG. 9 is a bottom plan view of the cutter assembly with the invention centralizer.
Figure 10:
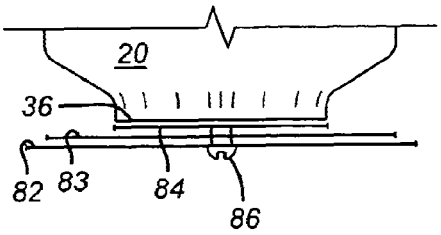
FIG. 10 is a side view of the invention centralizer.
Figure 11:
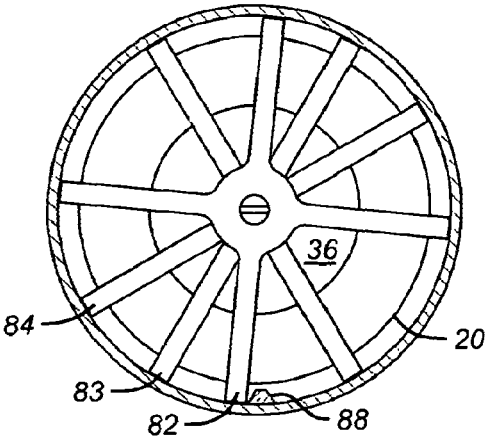
FIG. 11 is an operational plan view of the invention centralizer.

With respect of FIGS. 9, 10 and 11, a preferred centralizer assembly comprises a plurality of blade plates 82, 83, and 84. For example, a set of three blade plates may be used in a 1.50 inch tubing bore. Typically, the blades may be fabricated of Rockwell C60 hardness spring steel of approximately 0.004 inch thickness, having, for example, four, 0.250 inch wide blades with a 0.765 inch radius length. These blades are loosely stacked, serially, along the cylindrical, axially centralized, journal surface of shoulder screw 86. An axially centralized aperture through each of the blade plates is dimensioned to allow substantially free rotation of the plates about the shoulder screw journal surface. In the presently preferred embodiment, the shoulder screw head confines the several blade plates to the length of the shoulder screw journal surface.

Relative to prior art centralizer blade plates of about 0.015 inch thickness, approximately 0.765 inch radius length and approximately 0.250 inch width for a 1.50 inch tubing bore, the present invention provides a much lower bending strength for each blade and freedom to angularly reorient about the tool axis as it traverses the tubing bore length as represented by FIG. 11. The blade plate 82 is shown as rotated from angular symmetry by the internal tube seam weld 88 without compromise of a central radial alignment with the tube bore axis.

Substantially free rotation of the centralizer blade plates about the cutter assembly axis 13 has additional advantages in a wireline operation. Wirelines for downhole tool control and tethering typically comprise a double helix winding of high tensile strength wire with the outer layer winding turned in the opposite hand direction from the first, inner layer. These steel wire windings are laid around one or more insulated signal or electrical power conduits. Although the radial difference between the inner and outer windings is minute, this small difference imposes substantial torsional force over several miles of wireline length. To relieve the wireline of this internal torsional stress as the suspended tool descends into a well, the tool must be allowed to rotate about the tool/wireline axis. However, the frictional bearing of traditional centralizers on the internal bore wall of well tubing and the internal standing tube assembly seam of the well tubing inhibit any rotation of the tool as it descends into the well. Consequently, the wireline is restrained from relieving internal torsional stress. Resultantly, the two wound wire strength layers of the wireline may separate, forming a bulbous "bird cage" as it is known in the art. By permitting the centralizer blades to freely rotate about the tool axis, the wireline is allowed to rotate about its own axis to relieve this internal torsional stress.

The shaped charge assembly 40 is preferably spaced between the top sub end face 15 and the internal end-face 33 of the cutter housing 20 by a pair of resilient, electrically non-conductive, ring spacers 56 and 58. An air space of at least 0.100" is preferred between the top sub end face 15 and the adjacent face of the cutter assembly thrust disc 46. Similarly, a resilient, non-conductive lower ring spacer 58 provides an air space that is preferably at least 0.100" between the internal end-face 33 and the adjacent cutter assembly lower end plate 48.

Loose explosive particles can be ignited by impact or friction in handling, bumping or dropping the assembly. Ignition that is capable of propagating a premature explosion may occur at contact points between a steel, shaped charge thrust disc 46 or end plate 48 and a steel housing 20. To minimize such ignition opportunities, the thrust disc 46 and lower end plate 48, for the present invention, are preferably fabricated of non-sparking brass.

Figure 5:
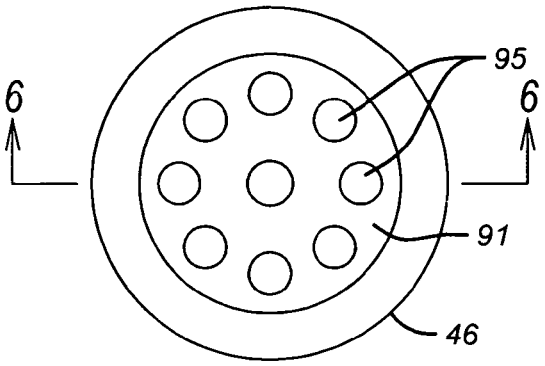
FIG. 5 is a plan view of an end plate showing marker pocket borings.
Figure 6:
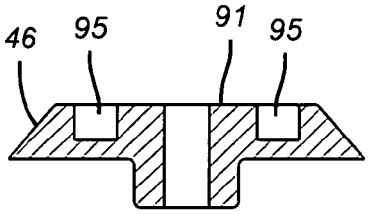
FIG. 6 is a cross-section view of an end plate along cutting plane 6-6 of FIG. 5.
Figure 7:
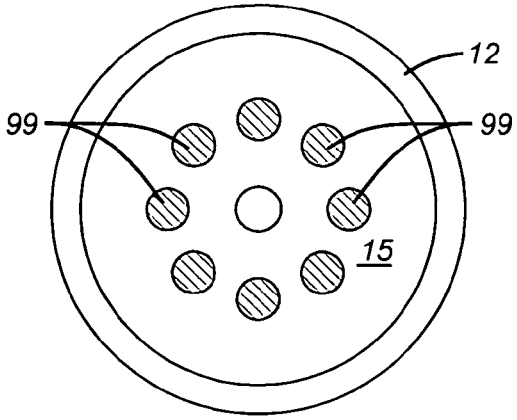
FIG. 7 is a bottom plan view of a top sub after detonation of the cutter.

The outer faces 91 and 93 of end plates 46 (upper thrust disc) and 48, as respectively shown by FIG. 1, are blind bored with marker pockets 95 in a prescribed pattern such as a circle with uniform arcuate spacing between adjacent pockets as illustrated by FIGS. 5 and 6. These pockets 95 in the outer face 91, 93 are shallow surface cavities that are stopped short of a complete aperture through the end plates to form selectively weakened areas of the end plates. When the explosive material 60 detonates, the marker pocket walls are converted to jet material in a development similar to a V-shaped charge cutting liner. These cutting jets of fluidized end plate material scar the lower end face 15 of the top sub 12 with impression marks 99 in a pattern corresponding to the original pockets as shown by FIG. 7. When the top sub 12 is retrieved after detonation, the uniformity and distribution of these impression marks 99 reveal the quality and uniformity of the detonation and hence, the quality of the cut. For example, if the top sub face 15 is marked with only a half section the end plate pocket pattern, it may be reliability concluded that only half of the cutter explosive correctly detonated.

Figure 8:
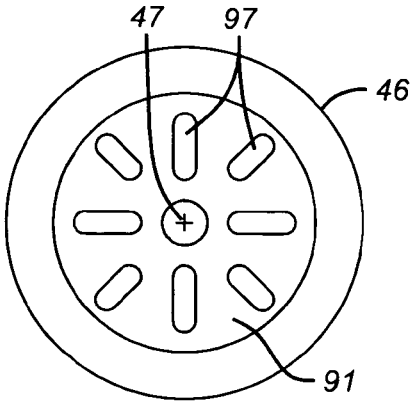
FIG. 8 is a plan view of a backing plate showing an alternative marker pocket pattern of slots.

FIG. 8 illustrates an alternative pattern of marker pockets shown as radial slots 97 distributed about the plate axis in substantially uniform arcuate segments.

The explosive material units 60 traditionally used in the composition of shaped charge tubing cutters comprises a precisely measured quantity of powdered, high explosive material such as RDX or HMX. The FIG. 1 invention embodiment includes a liner 50 that is formed into a truncated cone. The liner 50 substance may be an alloy of copper and lead, for example. In some cases, a thin sheet, 0.050", for example, of the alloy is mechanically formed to the frusto-conical configuration. Other methods of liner fabrication may provide a mixture of metal powders that is pressed or sintered to the frusto-conical form. In either case, the frusto-conical liner 50 is formed with open circular zones for the apex and base.

This frusto-conical liner 50 is placed in a press mold fixture with a portion of the fixture wall bridging the liner apex opening as an annulus around a central core post. A precisely measured quantity of powdered explosive material such as RDX or HMX is distributed within the internal cavity of the mold intimately against the interior liner surface and the fixture wall bridging the liner apex opening around the core post. Using a central core post as a guide mandrel through an axial aperture 47 in the upper thrust disc 46, the thrust disc is placed over the explosive powder and the assembly subjected to a specified compression pressure. This pressed lamination comprises a half section of the cutter assembly 40.

The lower half section of the charge assembly 40 is formed in the same manner as described above, each having a central aperture 62 of about 0.125" diameter in axial alignment with thrust disc aperture 47 and the end plate aperture 49. A complete cutter assembly comprises the contiguous union of the apex zone half sections respective to the lower and upper half sections along the juncture plane 64. Notably, the thrust disc 46 and end plate 48 are each fabricated around respective annular boss sections 70 and 72 that provide a protective material mass between the respective apertures 47 and 49 and the explosive material 60. These bosses are terminated by distal end faces 71 and 73 within a critical initiation distance of about 0.050" to about 0.100" from the assembly juncture plane 64 for a 2.50" cutter. The critical initiation distance may be increased or decreased proportionally for other sizes. Hence, the explosive material 60 is insulated from an ignition wave issued by the detonator 31 until the wave arrives in the proximity of the juncture plane 64.

Distinctively, the apertures 47, 49 and 62 for the FIG. 1 embodiment remain open and free of boosters or other explosive materials. Although an original explosive initiation point for the cutting charge 40 only occurs between the boss end faces 71 and 73, the original detonation event is generated by the detonator 31 outside of the thrust disc aperture 47. The detonation wave is channeled along the empty thrust disc aperture 47 to the empty central aperture 62 in the cutter explosive material. Typically, an explosive load quantity of 38.6 gms of HMX compressed to a loading pressure of 3,000 psi may require a moderately large detonator 31 of 420 mg HMX for detonation The FIG. 1 embodiment obviates any possibility of orientation error in the field while loading a cutter housing. A detonation wave may be channeled along either boss aperture 47 or 49 to the explosive 60 around the central aperture 62. Regardless of which orientation the shaped charge assembly is given when inserted in the housing 20, the detonator 31 will initiate the cutter explosive 60.

Figure 2:
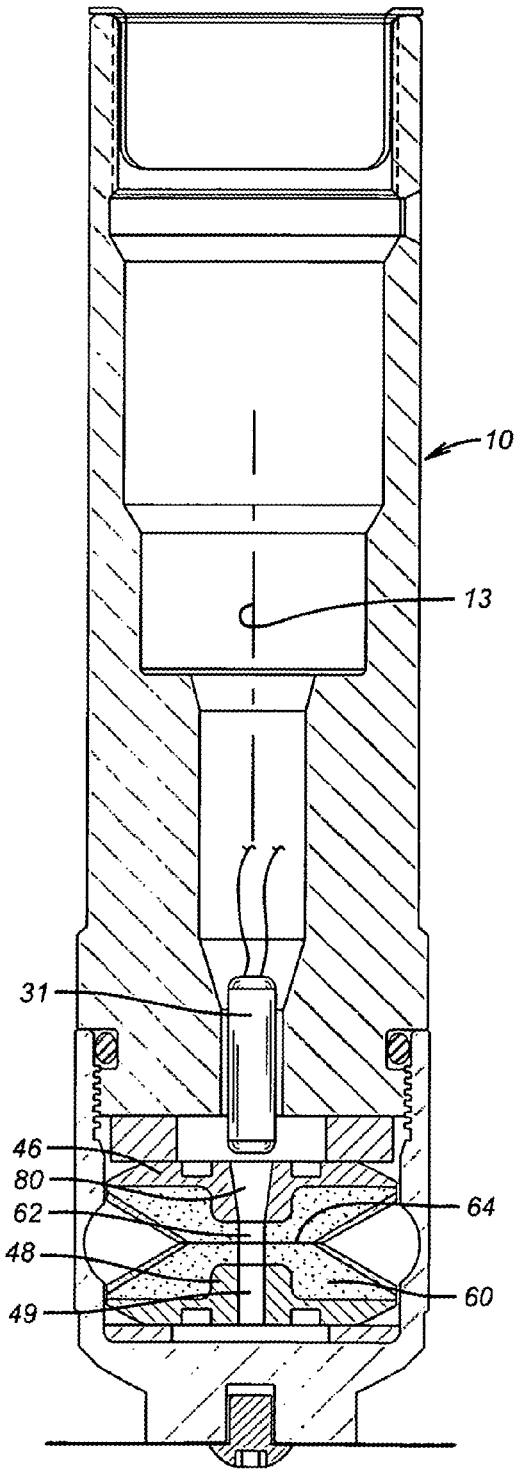
FIG. 2 is a cross-section of a second embodiment of the invention in assembly with the housing, centralizer and connecting sub.

A modification of the invention is represented by FIG. 2 showing the axial aperture 80 in the thrust disc 46 to be tapered with a conically convergent diameter from the disc face proximate of the detonator 31 to the central aperture 62. Typical of this embodiment, the thrust disc aperture 80 may have a taper angle of about 10° between an approximately 0.080" inner diameter to an approximately 0.125" diameter outer diameter. The taper angle, also characterized as the included angle, is the angle measured between diametrically opposite conical surfaces in a plane that includes the conical axis 13.

Original initiation of the FIG. 2 cutter charge 60 occurs at the outer plane of the tapered aperture 80 having initiation proximity with a detonator 31. The initiation shock wave propagates inwardly along the tapered aperture 80 toward the explosive junction plane 64. As the shock wave progresses axially along the aperture 80, the concentration of shock wave energy intensifies due to the progressively increased confinement and concentration of the explosive energy. Consequently, the detonator shock wave strikes the cutter charge 60 at the inner juncture plane 64 with an amplified impact.

Comparatively, the same explosive charge 60 as suggested for FIG. 1 comprising, for example, approximately 38.6 gms of HMX compressed under a loading pressure of about 3,000 psi, when placed in the FIG. 2 embodiment may require only a relatively small detonator 31 of HMX for detonation. Significantly, the conically tapered aperture 80 of FIG. 2 appears to focus the detonator energy to the central aperture 62 thereby igniting a given charge with much less source energy.

Figure 3:
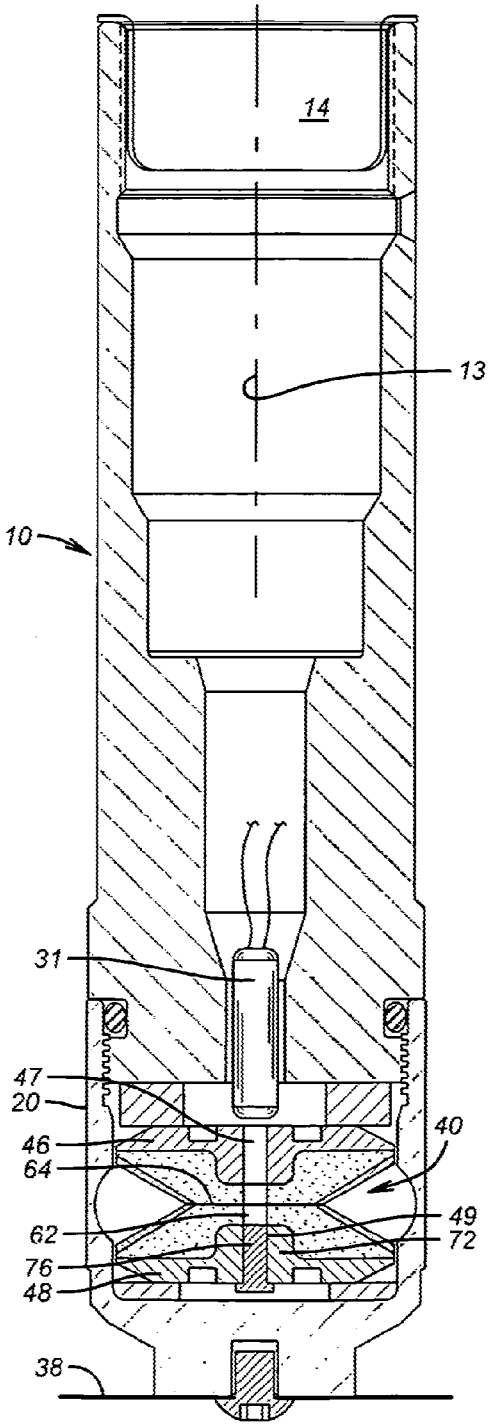
FIG. 3 is a cross-section of a third embodiment of the invention in assembly with the housing, centralizer and connecting sub.

Although the FIG. 3 invention embodiment relies upon an open, substantially cylindrical aperture 47 in the upper thrust disc 46 as shown in the FIG. 1 embodiment, either no aperture is provided in the end plate boss 72 of FIG. 3 or the aperture 49 in the lower end plate 48 is filled with a dense, metallic plug 76. The plug 76 may be inserted in the aperture 49 upon final assembly or pressed into place beforehand. As in the case of the FIG. 2 embodiment, a FIG. 3 cutter comprising, for example, approximately 38.6 gms of HMX compressed under a loading pressure of about 3,000 psi also may require only a relatively small detonator 31 of HMX for detonation. Apparently, the detonation wave emitted by the detonator 31 is reflected back upon itself in the central aperture 62 by the plug 76 thereby amplifying a focused concentration of detonation energy in the central aperture 62.

Figure 4:
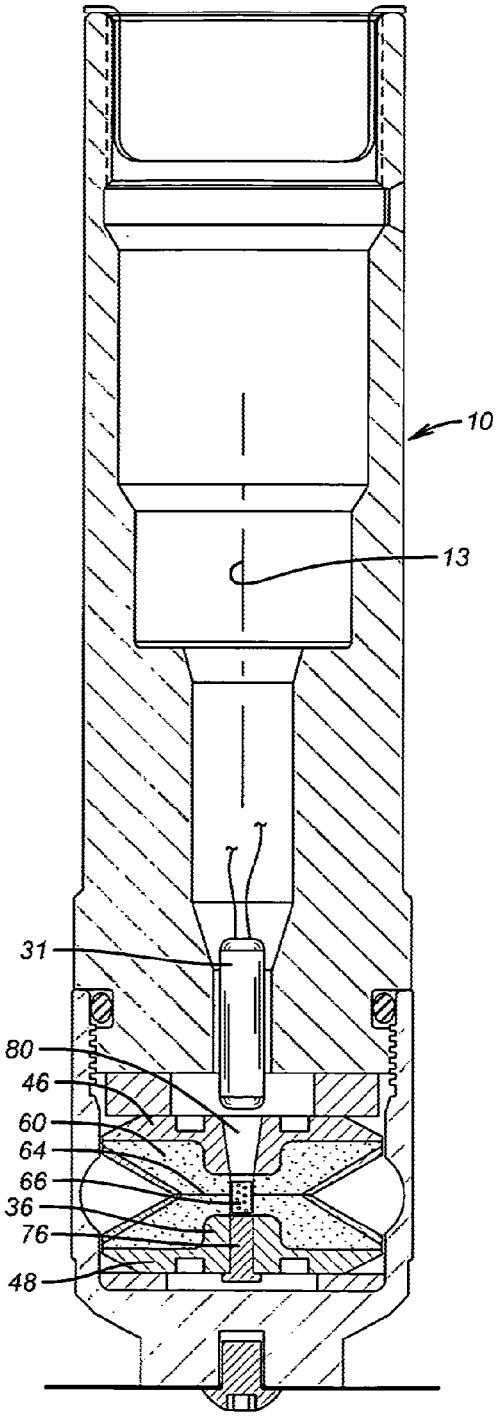
FIG. 4 is a cross-section of a fourth embodiment of the invention in assembly with the housing, centralizer and connecting sub.

The FIG. 4 invention embodiment combines the energy concentrating features of FIG. 2 and FIG. 3 but further adds a relatively small, explosive initiation pellet 66 in the central aperture 62. Of course, the explosive initiation pellet 66 concept may also be applied to the FIG. 1 embodiment.

Figure 12:
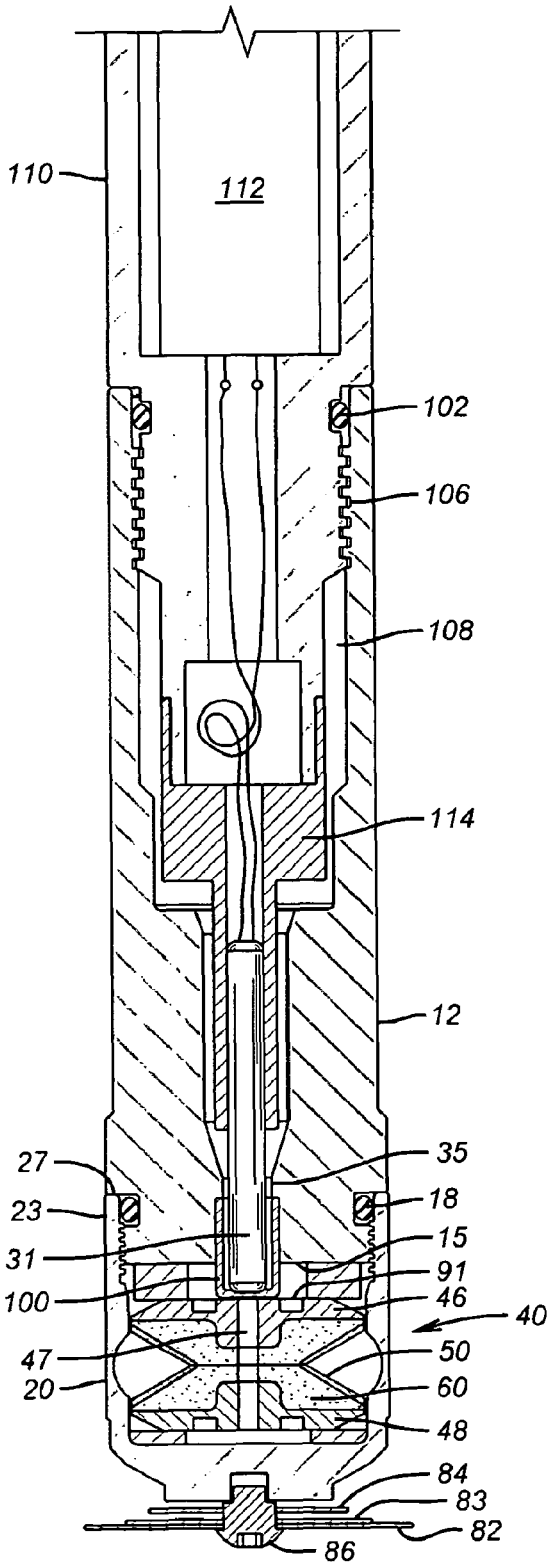
FIG. 12 is a cross-section of a fifth embodiment of the invention showing all essential elements of the firing head assembly.

The FIG. 12 invention embodiment is distinguished by the thin, 0.0097-0.010 in., material vessel shaped as a sealing cup 100 that separates the detonator 31 from the outer face of the thrust disc 46. Sealing cup 100 encloses the detonator 31 as a receptacle and includes a fluid tight rim or sidewall fit to the internal bore wall 35 of the top sub 12. This fluid tight fit between the cup 100 wall and the top sub bore wall 35 may be, for a few examples, an interference press fit, a threaded fit, a soldered fit or an integrally machined portion of the top sub 12 material. In any case, the distal end face of cup 100 is positioned from the lower end face 15 of the top sub as to assemble within about 0.032 in. of juxtaposition with the thrust disc 46 outer face 91 when the top sub shoulder 27 engages the distal edge of the cutter housing thread sleeve 23. This cup 100 provides an absolute barrier to any moisture that may penetrate any assembly seals 102 above the seal 18.

The cutter housing 20 is destroyed upon a single use by detonation of the explosive material 60. Hence, the interior sealing surfaces of the threaded sleeve 23 are normally new and highly polished to assure a fluid seal of the O-ring 18 across the low pressure transitional zone of a well bore. Also, the top sub 12, however, is not often reused. However, tubing or pipe string units above the top sub 12 having fluid paths through tool joints into the top sub cavity 108 frequently are subject to corruption, contamination and scarring due to repeated assembly and disassembly. For this reason, the seals 102 between the firing head housing 110 for the capacitance discharge unit 112 and the top sub 12 are more likely to leak as the tool descends the well bore through the low fluid pressure zone. Such leaks allow well bore fluid, mostly water, to migrate past the sub assembly threads 106 into the internal cavity 108. Once in the cavity 108, migrating fluid continues past the detonator retainer 114 into the cutter housing 20. This fluid flow path along the top sub cavity 108 is reliably blocked by the cup 100.

Operationally, the assembly is dimensioned to place the distal end of the detonator 31 against the interior bottom of the cup 100 when all assembly joints are tight. Since the detonator 31 is external of the charge aperture 47, it may be as large as need be to rupture the thin film of the cup 100 bottom and detonate the cutter explosive material 60.

Although several preferred embodiments of the invention have been illustrated in the accompanying drawings and describe in the foregoing specification, it will be understood by those of skill in the art that additional embodiments, modifications and alterations may be constructed from the invention principles disclosed herein. These various embodiments have been described herein with respect to cutting a "pipe." Clearly, other embodiments of the cutter of the present invention may be employed for cutting any tubular good including, but not limited to, pipe, tubing, production/casing liner and/or casing. Accordingly, use of the term "tubular" in the following claims is defined to include and encompass all forms of pipe, tube, tubing, casing, liner, and similar mechanical elements.

Having thus described the preferred embodiments, the invention is claimed as follows:

1. An explosive well tool assembly comprising:

a shaped charge housing secured to a top sub, an explosive shaped charge within said housing, said shaped charge having first and second substantially matched explosive units, each unit being a singular element developed substantially symmetrically about an axis of revolution, each unit comprising an explosive material intimately formed between a conical metallic liner and a metallic backing plate, a truncated apex of said liners joined coaxially along a substantially common juncture plane, each of said backing plates having an external surface opposite from said explosive material and substantially normal to said axis of revolution, an external surface of at least one backing plate having a plurality of blind pockets therein distributed in a prescribed pattern about said axis, said top sub having a substantially planar distal end-face aligned substantially normal to said axis, assembly means for securing said housing to said top sub with a plane of said one backing plate external surface adjacent to and substantially parallel with said top sub end-face plane, and a moisture barrier secured to said top sub between a detonator and said explosive shaped charge to prevent the transfer of moisture from a cavity of said top into said shaped charge housing, said moisture barrier comprising a cup member having a rim wall and a vessel volume wherein said rim wall is secured to said top sub around an aperture and said vessel volume encloses a distal end of said detonator.

2. The explosive well tool assembly as described by claim 1, wherein said blind pockets in said one backing plate comprise a plurality of blind borings into said external surface, said borings distributed in a circle about said axis.

3. The explosive well tool assembly as described by claim 1, wherein said blind pockets in said one backing plate comprise a plurality of slots into said external surface extending radially from said axis and distributed thereabout in substantially uniform arcuate increments.

4. A top sub for a detachable well tool explosive housing, said top sub comprising:

a central cavity opening through a distal end aperture, an explosive detonator positioned within said top sub cavity to project through said end aperture into detonation proximity with an explosive charge within said tool housing and a moisture barrier means secured to said top sub between said detonator and said explosive charge to prevent the transfer of moisture from said top sub cavity into said explosive housing, said moisture barrier comprising a cup member having a rim wall and a vessel volume wherein said rim wall is secured to said top sub around said distal end aperture and said vessel volume encloses a distal end of said detonator.

5. The top sub as described by claim 4, wherein said rim wall is materially integral with said top sub.

* * * * *